United States Patent [19]

Musgrave

[11] 4,236,338

[45] Dec. 2, 1980

[54] MAGAZINE SPRING ADJUSTMENT APPARATUS

[76] Inventor: Daniel D. Musgrave, 8201 Caraway St., Cabin John, Md. 20731

[21] Appl. No.: 15,861

[22] Filed: Feb. 27, 1979

[51] Int. Cl.[3] ..... F41C 27/00

[52] U.S. Cl. ..... 42/90

[58] Field of Search ..... 42/90, 50, 1 R

[56] References Cited

U.S. PATENT DOCUMENTS

| | | | |
|---|---|---|---|
| 3,087,270 | 4/1963 | Stoner | 42/50 |
| 3,205,604 | 9/1965 | Plumer | 42/50 |
| 3,443,334 | 5/1969 | Ardolino | 42/50 |
| 3,964,199 | 6/1976 | Musgrave | 42/50 |

*Primary Examiner*—Charles T. Jordan

[57] ABSTRACT

Apparatus for adjusting the stress in cartridge magazine springs which are arranged for such adjustment. The magazines are stored with the springs in a non-stressed condition. When use of the magazine is imminent, the springs are adjusted to a stressed condition. Disclosed hereinafter is power-driven and hand-operated apparatus to accomplish the adjustment. The apparatus may be mounted on a firearm, a magazine carrying rack, a vehicle, a boat, an aircraft, or any other suitable base.

8 Claims, 7 Drawing Figures

MAGAZINE SPRING ADJUSTMENT APPARATUS

U.S. Pat. No. 3,964,199 discloses an Adjustable Spring Assembly which can be installed in a limited space within a cartridge magazine while in a non-stressed condition. When the magazine is to be used, some parts of the spring are moved in relation to others, causing the spring assembly to exert thrust in a predetermined direction.

The force required to thus move the parts of the spring is determined by well-known physical laws, and is significant. A plunger, extending out through a hole in the magazine casing, must be pushed in to exert this force. Under adverse conditions this may be difficult; for example, if the user's hands are chilled, he might be unable to adjust the spring by hand, without some mechanical assistance.

It is an object of this invention to provide mechanical devices by which adjustable magazine springs can be stressed.

It is also an object of this invention to provide such devices for mounting on firearms, vehicles, boats, aircraft, and similar equipment.

These and other objects of the present invention will become apparent upon reference to the following specification, taken in connection with the accompanying drawings, wherein.

The drawings have been prepared in simplified form, for clarity of disclosure. No particular magazine or rifle is shown. The invention will be useful with magazines for various classes of firearms. The drawings are exemplary and it is not intended to limit the scope of utility of the invention by the illustrations.

Figure 1:
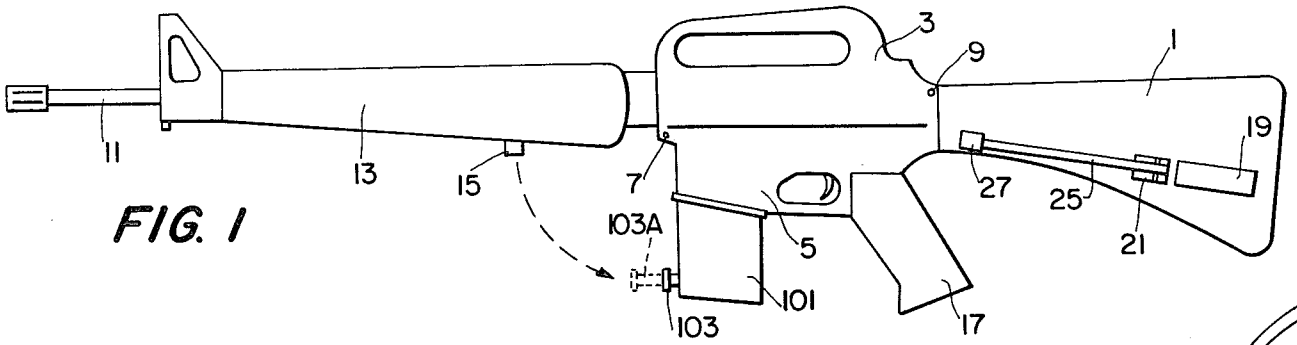
FIG. 1 is a side elevation of a typical military rifle, with magazine spring adjustment apparatus installed in its stock.

Referring to the drawings in detail FIG. 1 shows a typical modern rifle having a stock 1, a receiver 3, and a frame 5. The frame and receiver are hinged together by a hinge pin 7. A removable latch pin 9 normally prevents the frame and receiver from pivoting apart.

Supported in the receiver is barrel 11 which is partly covered by a hand guard 13 which serves as a front grip during firing. A block 15 is affixed to the hand guard. The purpose of the block will be explained later.

Supported by the frame is firing grip 17 with which is associated the usual trigger means. The forward part of the frame comprises a magazine housing into which is inserted a magazine 101, in the usual manner. Magazine 101 is of the type which includes an adjustable spring, and it has protruding from it a lug 103 which is used to adjust the spring. This is indicated by the two positions shown for the lug. When the lug is extending substantially out of the magazine, as shown by the broken lines at 103A, the spring within the magazine is relaxed.

When the lug is pushed substantially into the magazine, as shown at 103, the spring is stressed.

Details of how the spring is so stressed are disclosed in U.S. Pat. No. 3,964,199, already mentioned.

A magazine spring adjusting apparatus is built into stock 1. It is disclosed in FIGS. 1, 2, and 3. Formed laterally through the stock is a slot 19 which is dimensioned to permit insertion of a magazine, such as 101, therein as in FIGS. 2 and 3. Also formed through the stock is another slot 21 which is adapted to support a mounting pin 23. Pin 23 serves as a fulcrum for a curved lever 25 which can be stored along the side of stock 1 when not in use. It can be retained in that position by a simple spring clip 27 affixed to the stock, when not in use.

Figure 2:
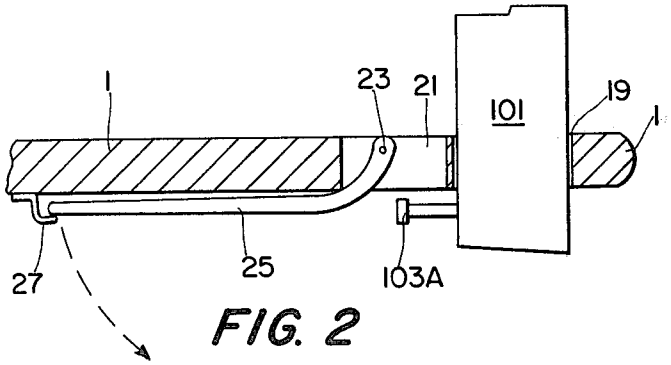
FIG. 2 is a horizontal section of the apparatus shown in FIG. 1.

Operation is as follows. A magazine with its spring not stressed is inserted into slot 19 until its lug 103A is substantially aligned with the path swept by lever 25 when it is pivoted away from the stock. The slots for the lever and the magazine are in the same plane and the dimensions of slot 19 are so chosen as to support the magazine in a predetermined position as shown in FIG. 2.

Figure 3:
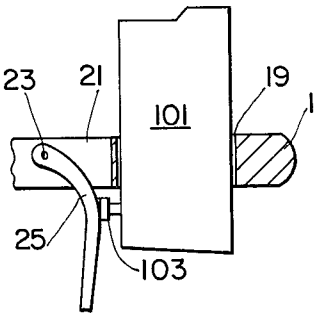
FIG. 3 is also a horizontal section of the same apparatus, with a certain part in a different position.

The axis of rotation of lever 25 upon pin 23 is so chosen that the curved portion of the lever can pivot against the lug of the magazine as may be seen at 103 in FIG. 3. When the lug is thus forced into the magazine its internal spring is adjusted to a stressed condition.

The operations of inserting a magazine, releasing and moving the lever, storing and latching the lever, and removing the magazine from the slot will not interfere with the normal readiness of the rifle, assuming that it is ready.

Some modern rifles have the receiver pivoted relative to the frame to permit easy disassembly. In FIG. 1, for example, barrel 11 with frame 3 can be pivoted on pin 7 which is supported in frame 5, after pin 9 is removed.

This pivoting relationship can be used to provide a simple magazine spring adjusting apparatus. Magazine 101 is installed in the forward portion of frame 5 in the normal manner. If the magazine spring requires adjustment pin 9 is removed and the barrel and receiver are pivoted down causing block 15 to travel along the curved path indicated by the broken line in FIG. 1. When it contacts lug 103A on magazine 101, it can force it into the magazine as shown at 103. The gun itself thus provides leverage to adjust the spring.

Although this arrangement is simpler and weighs less than the apparatus built into the stock, it requires that the rifle be rendered inoperative while it is used. But it has the advantage of extreme simplicity.

Figure 4:
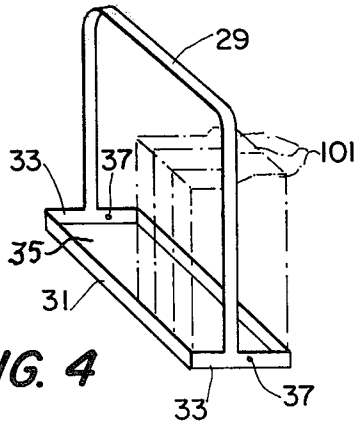
FIG. 4 is a view of a magazine carrying rack.

FIG. 4 shows a magazine carrying rack having a handle 29, sides 31 of which only one is visible in the drawing, ends 33, and a botton 35. Formed in each end 33 is a hole 37. The rack is adapted for carrying a plurality of magazines 101 as indicated in broken lines.

Figure 5:
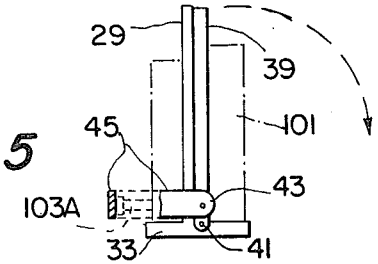
FIG. 5 shows how a magazine spring adjustment apparatus can be installed in such a rack.

A magazine spring adjustment apparatus can be incorporated into the rack as shown in FIG. 5 which is an end view of FIG. 4 with additional elements added.

A second handle 39 is installed next to handle 29. Handle 39 is pivotable relative to the rack by any suitable fastener 41 which passes through a hole in handle 39 and engages in hole 37 in the rack. The handle is thus capable of pivoting substantially as indicated by the broken arc in FIG. 5.

Pivotably connected to handle 39 at 43 is a U-shaped bar 45. Only one end of the handle, and one end of the bar, is visible in FIG. 5, but the other end of each is similar, including the pivotable connections. The bar extends along the front of any magazines in the rack just touching lugs 103A.

It is assumed that magazines in the rack are firmly supported in position by sides 31. When it is desired to adjust the springs of the magazines, handle 39 is pivoted away from handle 29. A powerful leverage is exerted on bar 45 which pushed lugs 103A into the magazines.

While disclosed as an open rack, it is apparent that this arrangement could easily be adapted to a magazine-carrying box, crate, or other package.

Figure 6:
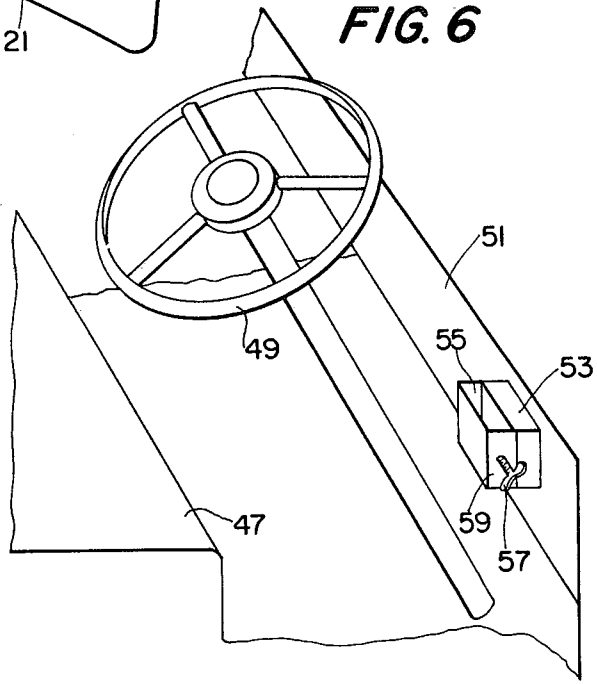
FIG. 6 shows a magazine spring adjustment apparatus mounted on a human transportation conveyance.

FIG. 6 shows a magazine spring adjustment apparatus mounted on a human transportation conveyance, which might be an aircraft, a boat, or a land vehicle, such as a mechanized infantry combat vehicle. The last named is the basic vehicle in modern infantry forces, and it must carry a large supply of rifle ammunition, in magazines, in addition to that carried on the person of the troops.

Shown in FIG. 6 is a crew seat 47, a vehicle control 49 and a bulkhead 51. A spacer 53 is affixed to the bulkhead in any convenient manner. On the spacer is mounted a socket 55 adapted to support a magazine such as 101 in FIG. 1. The socket is arranged to support the magazine with lug 103A aligned with a wing bolt 57 which passes through a threaded hole in end 59 of the socket.

When it is desired to adjust the spring of a magazine it is inserted into the socket and wing bolt 57 is turned to exert thrust against it. It is apparent that a lever could be used, if desired, rather than a wing bolt. But it is intended to here emphasize that a spring adjustment apparatus can readily be mounted on land vehicles, aircraft and water craft.

Figure 7:
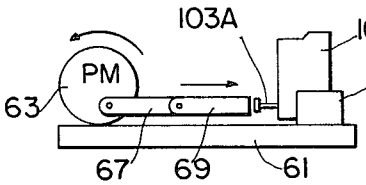
FIG. 7 shows a power-driven magazine spring adjustment apparatus.

FIG. 7 discloses a magazine spring adjustment apparatus that is power-driven. The Figure is schematic. On a base 61 is mounted a prime mover 63 which is also marked PM. Also fixed to the base is a magazine support 65 which is supporting a magazine 101. By means of link 67 the prime mover can move rammer 69 against lug 103A of the magazine to adjust the stress of the spring in the magazine. It is apparent that this apparatus can be arranged to perform the adjustment on a plurality of magazines simultaneously. Mechanical details of such prime movers, links and rammers are well-known and need not be described here. The arrows on FIG. 7 indicate the direction of movement of the prime mover and the rammer to exert the desired thrust.

The various apparatus described and illustrated can be arranged to adjust springs in magazine having different configurations. This can be accomplished by so choosing the shape and dimensions of the means provided to support the magazines that it can accept such different configurations.

There is thus disclosed several types of apparatus for adjusting the stress in a cartridge magazine spring. It will be noted that the several types meet the needs of various echelons of an ammunition supply system. Power-driven apparatus can be used at the depot level. The small combat unit can be provided with simpler apparatus, on vehicles or in carrying racks. The individual user can be provided with extremely simple apparatus on his rifle, which will thus always be available to him.

What I claim is:

1. Apparatus for adjusting stress in an adjustable-stress spring within a cartridge magazine, comprising: a base; means on said base to support said magazine; and power-driven mechanism on said base positionally adapted to exert thrust in a predetermined direction against adjusting means on said magazine thereby adjusting stress in said spring.

2. Apparatus as set forth in claim 1 wherein said means on said base is adapted to support a plurality of magazines and said mechanism is adapted to exert said thrust against said plurality in a predetermined direction.

3. Apparatus as set forth in claim 1 wherein said means on said base is adapted to support various magazines having different configurations.

4. Apparatus adapted for adjusting stress in an adjustable stress spring within a cartridge magazine; said apparatus including a base pivotably supporting lever means adapted to exert thrust whereby said spring can be adjusted.

5. Apparatus as set forth in claim 4 wherein said base is a part of a firearm.

6. Apparatus as set forth in claim 4 wherein said base is a magazine rack.

7. Apparatus as set forth in claim 4 wherein said base is a magazine box.

8. On a firearm having a receiver pivotable relative to magazine support means fixed on a frame, a device movable with said receiver and positionally adapted to exert thrust in a predetermined direction against adjusting means on a magazine held in said support means when said receiver is pivoted relative to said frame.

* * * * *